US011239612B2

(12) United States Patent
Lee et al.

(10) Patent No.: US 11,239,612 B2
(45) Date of Patent: Feb. 1, 2022

(54) CONNECTOR AND CONNECTOR DEVICE

(71) Applicant: HIROSE ELECTRIC CO., LTD., Kanagawa (JP)

(72) Inventors: Yongjin Lee, Kanagawa (JP); Shiro Sunaga, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/069,492

(22) Filed: Oct. 13, 2020

(65) Prior Publication Data

US 2021/0119386 A1 Apr. 22, 2021

(30) Foreign Application Priority Data

Oct. 16, 2019 (JP) ..... JP2019-189097

(51) Int. Cl.

| | |
|---|---|
| ***H01R 13/6582*** | (2011.01) |
| ***H01R 24/60*** | (2011.01) |
| ***H01R 13/11*** | (2006.01) |
| ***H01R 13/6583*** | (2011.01) |
| ***H01R 12/71*** | (2011.01) |
| ***H01R 13/6594*** | (2011.01) |
| *H01R 13/6581* | (2011.01) |
| *H01R 12/73* | (2011.01) |

(52) U.S. Cl.

CPC ..... *H01R 13/6582* (2013.01); *H01R 12/716* (2013.01); *H01R 13/112* (2013.01); *H01R 13/113* (2013.01); *H01R 13/6583* (2013.01); *H01R 13/6594* (2013.01); *H01R 24/60* (2013.01); *H01R 12/71* (2013.01); *H01R 12/712* (2013.01); *H01R 12/73* (2013.01); *H01R 13/6581* (2013.01)

(58) Field of Classification Search

CPC ..... H01R 13/6582; H01R 12/716; H01R 13/112; H01R 13/113; H01R 13/6583; H01R 13/6594; H01R 24/60; H01R 12/71; H01R 12/712; H01R 12/73; H01R 13/6581; H01R 13/6585; H01R 13/2407

See application file for complete search history.

(56) References Cited

U.S. PATENT DOCUMENTS

2018/0342838 A1* 11/2018 Ozeki ..... H01R 12/716

FOREIGN PATENT DOCUMENTS

JP 2017-33909 A 2/2017

* cited by examiner

*Primary Examiner* — Abdullah A Riyami
*Assistant Examiner* — Justin M Kratt
(74) *Attorney, Agent, or Firm* — Rankin, Hill & Clark LLP

(57) ABSTRACT

A connector device includes: a plug connector including a plurality of plug terminals, a plug housing that holds the plurality of plug terminals in its longitudinal direction, and a plug shell held by the plug housing; and a receptacle connector including a plurality of receptacle terminals, a receptacle housing that holds the receptacle terminals along its longitudinal direction, and a receptacle shell held by the receptacle housing. The plug shell and the receptacle shell are electrically connected to each other through at least the contact portion in a state where the plug connector and the receptacle connector is fitted with each other.

21 Claims, 9 Drawing Sheets

CONNECTOR AND CONNECTOR DEVICE

CROSS-REFERENCE TO RELATED APPLICATION

This application claims priority from Japanese Patent Application No. 2019-189097 filed with the Japan Patent Office on Oct. 16, 2019, the entire content of which is hereby incorporated by reference.

BACKGROUND

1. Technical Field

One aspect of the present disclosure relates to a connector and a connector device.

2. Related Art

The connector device has, for example, a rectangular housing, and a plug-side connector (plug connector) and a receptacle-side connector (receptacle connector) that connect substrates together. A plurality of terminals is arranged in two rows in the housing in its longitudinal direction by insert molding (integral molding) or the like. Such a connector device is disclosed in, for example, JP-A-2017-033909.

The plug connector and the receptacle connector can be provided on a printed wiring board, a flexible flat cable, or the like. For example, the receptacle connector provided on the printed wiring board by surface mounting or the like and the plug connector provided on an end of the flexible flat cable are fitted to each other, so that the substrates can be connected to each other.

In recent years, in mobile terminals such as smartphones, for example, transmission data has been increased in capacity and transmission speed has been increased. The connector device including the plug connector and the receptacle connector for connecting the substrates built in the mobile terminals is required to accurately transmit a high-frequency electric signal with little loss. Therefore, transmission between the plug connector and the receptacle connector, which transmits and receives the high-frequency electric signal through the terminals, is required to satisfy a characteristic (high-frequency characteristic) requirement for a high-frequency signal.

One of factors that hinder the requirement for such a high-frequency characteristic is so-called electromagnetic interference (EMI) such as an electromagnetic noise signal generated from the terminal of the connector. In the connector device disclosed in JP-A-2017-033909 as a conventional example, each of the plug connector and the receptacle connector is provided with a shield wall portion so as to extend in the longitudinal direction. The shield wall portion exerts an electromagnetic shielding effect for the electromagnetic noise signal generated from a mounting portion (contact connecting portion) provided at an end of the terminal of each connector. This addresses the electromagnetic interference. Specifically, in the conventional connector device, when the plug connector and the receptacle connector are fitted to each other, the shield wall portions respectively provided on the connectors are arranged to face each other in a connector width direction (short direction). In the connector device of the conventional example, the shield wall portions are, for example, doubly arranged inside and outside, so that the electromagnetic shielding effect can be obtained. In this way, EMI countermeasures are taken.

SUMMARY

A connector device includes: a plug connector including a plurality of plug terminals, a plug housing that holds the plurality of plug terminals in its longitudinal direction, and a plug shell held by the plug housing; and a receptacle connector including a plurality of receptacle terminals, a receptacle housing that holds the receptacle terminals along its longitudinal direction, and a receptacle shell held by the receptacle housing. The plug shell includes a plug shell plane facing the receptacle connector when the connectors are fitted to each other, a plate-like first plug shield extending in the longitudinal direction of the plug housing, a plate-like second plug shield extending in a short direction of the plug housing, a plug housing support portion held by the plug housing, and a plug shell mounting portion connected to a ground potential of a substrate, the first plug shield faces the plug terminals in the short direction, the receptacle shell includes a receptacle shell plane facing the plug connector when the connectors are fitted to each other, a plate-like first receptacle shield extending in the longitudinal direction of the receptacle housing, a plate-like second receptacle shield extending in a short direction of the receptacle housing, a receptacle housing support portion held by the receptacle housing, and a receptacle shell mounting portion connected to the ground potential of the substrate, the first receptacle shield faces each of the plurality of the receptacle terminals in the short direction, one shell plane out of the plug shell plane and the receptacle shell plane includes a contact portion, which extends from the corresponding shell plane, is formed by being bent in a fitting direction with a mating connector, and is configured to contact the other shell plane when the connectors are fitted to each other, and when the plug connector and the receptacle connector are fitted to each other, the plug shell and the receptacle shell are electrically connected to each other through at least the contact portion.

DETAILED DESCRIPTION

Figure 1:
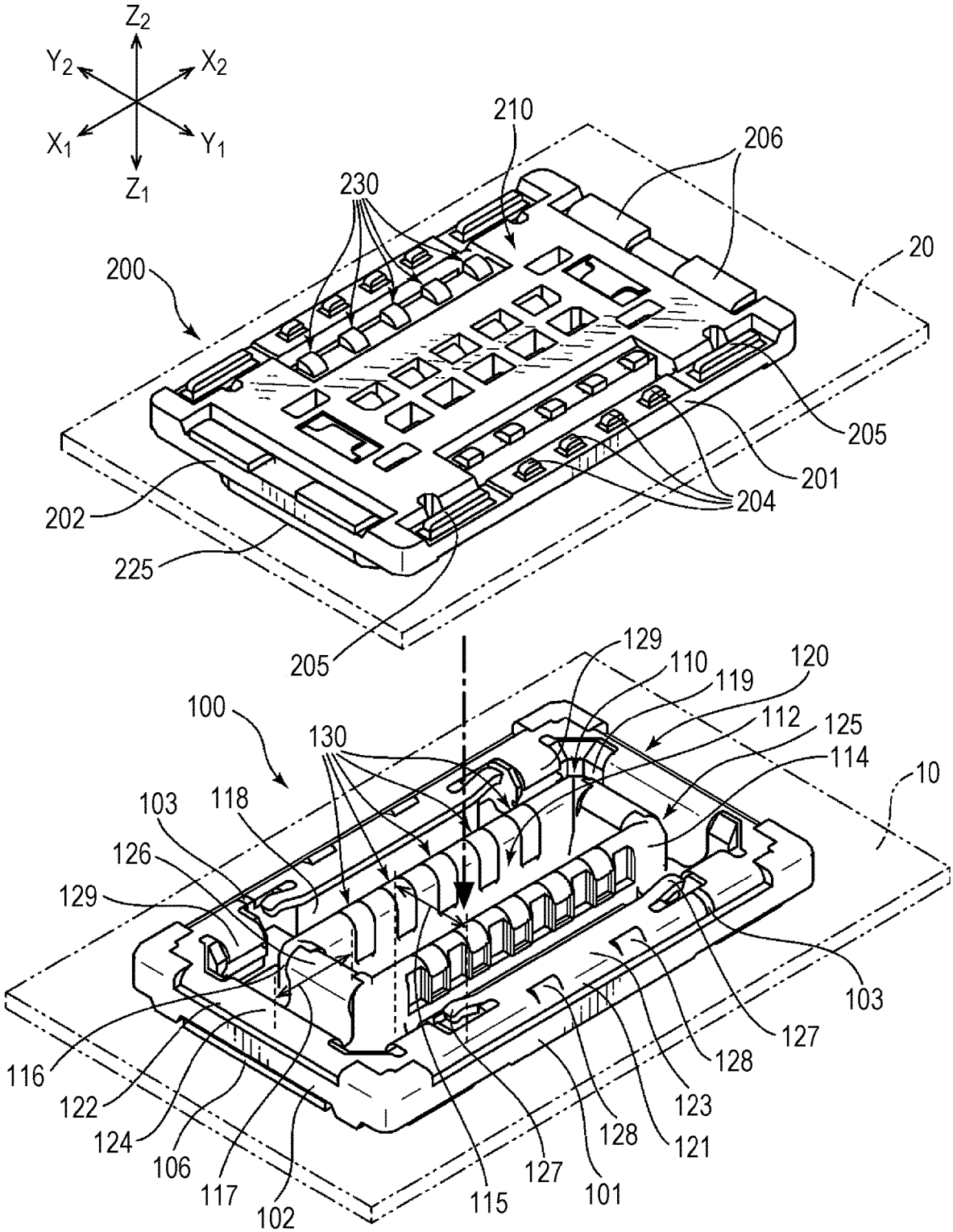
FIG. 1 is a diagram illustrating a connector device according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In general, as electronic devices such as smartphones and mobile terminals have been smaller and more sophisticated, components such as connectors for connecting elements and substrates in a printed wiring board have been more highly densely mounted. There is also a demand for miniaturization of the connector itself that is the component. However, in the conventional connector device, shield wall portions that are provided to extend in a longitudinal direction of the connectors are doubly arranged inside and outside when the connectors are fitted to each other. Due to this double structure of inner and outer shield walls, a width of the connectors in a short direction is increased. This hinders miniaturization of the connectors. That is, this hinders reduction of an area occupied by the connector on the substrate, and high-density mounting.

In the conventional connector device, a contact portion projecting in a lateral direction (horizontal direction with respect to the substrate) is provided on a side surface of a shield wall portion of one connector. The contact portion is brought into contact with the shield wall portion of the other connector facing each other at the time of fitting. Thus, an electromagnetic shielding effect is obtained. Therefore, in the conventional connector device, the double structure of the inner and outer shield walls is an essential structure. Therefore, in the conventional connector device, it is difficult to remove the double structure of the inner and outer shield walls in order to miniaturize the connector.

An object of the present disclosure is to provide a connector device as described below. The connector device does not use the double structure of the inner and outer shield walls. The connector device has a plug connector and a receptacle connector. Each of the plug connector and the receptacle connector includes a housing holding a plurality of terminals arranged in the longitudinal direction, and a shield having a shell plane provided in the longitudinal direction of the housing. In the connector device, when the connectors are fitted to each other, two planes contact each other by the contact portions extending from one plane to the other plane of the shell planes facing each other. Thus, the shield for electromagnetically shielding the terminals of the plug connector and the shield for electromagnetically shielding the terminals of the receptacle connector are electrically connected to each other. Thus, a potential difference between the shields can be substantially removed. As a result, it is possible to obtain a sufficient electromagnetic shielding effect.

A connector device (this connector device) according to an embodiment of the present disclosure includes: a plug connector including a plurality of plug terminals, a plug housing that holds the plurality of plug terminals in its longitudinal direction, and a plug shell held by the plug housing; and a receptacle connector including a plurality of receptacle terminals, a receptacle housing that holds the receptacle terminals along its longitudinal direction, and a receptacle shell held by the receptacle housing. The plug shell includes a plug shell plane facing the receptacle connector when the connectors are fitted to each other, a plate-like first plug shield extending in the longitudinal direction of the plug housing, a plate-like second plug shield extending in a short direction of the plug housing, a plug housing support portion held by the plug housing, and a plug shell mounting portion connected to a ground potential of a substrate, the first plug shield faces the plug terminals in the short direction, the receptacle shell includes a receptacle shell plane facing the plug connector when the connectors are fitted to each other, a plate-like first receptacle shield extending in the longitudinal direction of the receptacle housing, a plate-like second receptacle shield extending in a short direction of the receptacle housing, a receptacle housing support portion held by the receptacle housing, and a receptacle shell mounting portion connected to the ground potential of the substrate, the first receptacle shield faces each of the plurality of receptacle terminals in the short direction, one shell plane out of the plug shell plane and the receptacle shell plane includes a contact portion, which extends from the corresponding shell plane, is formed by being bent in a fitting direction with a mating connector, and is configured to contact the other shell plane when the connectors are fitted to each other, and when the plug connector and the receptacle connector are fitted to each other, the plug shell and the receptacle shell are electrically connected to each other through at least the contact portion.

In the preferred embodiment of the connector device, the contact portion is a contact piece having elasticity, and is configured to contact the other shell plane to be pushed down, when the connectors are fitted to each other, and one connector out of the plug connector and the receptacle connector, which includes the one shell plane including the contact portion, has a space for accommodating the contact portion pushed down.

In the preferred embodiment of the connector device, the plug shell plane or the receptacle shell plane includes a protrusion formed to protrude from its surface, and the protrusion is configured to contact the shell plane of the mating connector when the plug connector and the receptacle connector are fitted to each other.

In the preferred embodiment of the connector device, the plug housing includes a fitting recess surrounded by a first fitting side wall extending in the longitudinal direction and a second fitting side wall extending in the short direction, and a first plug side wall extending in the longitudinal direction and a second plug side wall extending in the short direction, which surround the first fitting side wall and the second fitting side wall, the plug housing support portion includes a first plug housing support portion provided on the second plug side wall and a second plug housing support portion provided on the second fitting side wall, the receptacle housing includes a fitting protrusion surrounded by a first receptacle side wall extending in the longitudinal direction and a second receptacle side wall extending in the short direction, the receptacle housing support portion includes a first receptacle housing support portion provided on the second receptacle side wall and a second receptacle housing support portion provided on the fitting protrusion, and when the plug connector and the receptacle connector are fitted to each other, the first receptacle housing support portion is fitted between the first plug housing support portion and the second plug housing support portion, and the second plug housing support portion is fitted between the first receptacle housing support portion and the second receptacle housing support portion, so that the plug shell and the receptacle shell are electrically connected to each other.

In the preferred embodiment of the connector device, the plug shell includes a plug side wall connecting portion provided on the first plug side wall near a corner in which the first plug side wall and the second plug side wall intersect, the receptacle shell includes a receptacle side wall connecting portion provided on the first receptacle side wall near a corner in which the first receptacle side wall and the second receptacle side wall intersect, and when the plug connector and the receptacle connector are fitted to each other, the plug side wall connecting portion and the receptacle side wall connecting portion contact each other, so that the plug shell and the receptacle shell are electrically connected to each other.

In the preferred embodiment of the connector device, the plug housing includes a first plug outer wall that covers the first plug shield and a second plug outer wall that covers the second plug shield, the plug shell mounting portion is exposed from the first plug outer wall or the second plug outer wall, the receptacle housing includes a first receptacle outer wall that covers the first receptacle shield and a second receptacle outer wall that covers the second receptacle shield, and the receptacle shell mounting portion is exposed from the first receptacle outer wall or the second receptacle outer wall.

In the preferred embodiment of the connector device, the plug terminals are provided along the first fitting side wall, the first plug shield faces the first fitting side wall provided with the plug terminals at equal intervals in the short direction, the receptacle terminals are provided along the first receptacle side wall, and the first receptacle shield faces the first receptacle side wall provided with the plurality of receptacle terminals at equal intervals in the short direction.

In the preferred embodiment of the connector device, the first plug shield is an edge portion of the plug shell bent at a right angle to the plug shell plane, and the first receptacle shield is an edge portion of the receptacle shell bent at a right angle to the receptacle shell plane.

In the preferred embodiment of the connector device, the plug shell planes extend in the longitudinal direction on both sides of the fitting recess, the receptacle shell planes extend in the longitudinal direction on both sides of the fitting protrusion, and two of the contact portions are provided on each of the plug shell planes that extend in the longitudinal direction on both sides of the fitting recess or on each of the receptacle shell planes that extend in the longitudinal direction on both sides of the fitting protrusion.

In the preferred embodiment of the connector device, the plug shell has two cuts in the plug shell plane, and the two cuts are located point-symmetrically with respect to a central axis in the fitting direction, and the receptacle shell has two cuts in the receptacle shell plane, and the two cuts are located point-symmetrically with respect to the central axis in the fitting direction.

A connector (this connector) according to an embodiment of the present disclosure includes a plurality of terminals, a housing that holds the terminals in its longitudinal direction, and an outer conductor shell held by the housing. The outer conductor shell includes a shell plane facing a mating connector at the time of fitting, a plate-like first shield extending in the longitudinal direction of the housing, a plate-like second shield extending in a short direction of the housing, a support portion held by the housing, and a shell mounting portion connected to a ground potential of a substrate, the first shield faces each of the terminals in the short direction, the shell plane includes a contact portion, which extends from the shell plane, is formed by being bent in a fitting direction with the mating connector, and is configured to contact a mating shell plane of the mating connector when the connectors are fitted to each other, and the outer conductor shell is electrically connected to a mating outer conductor shell of the mating connector through at least the contact portion in a fitting state with the mating connector.

In the preferred embodiment of the connector, the contact portion is a contact piece having elasticity, and is configured to contact the mating shell plane of the mating connector to be pushed down, when the connectors are fitted to each other, and the connector has a space for accommodating the contact portion pushed down.

In the preferred embodiment of the connector, the shell plane includes a protrusion formed to protrude from its surface, and the protrusion is configured to contact the mating shell plane of the mating connector in the fitting state with the mating connector.

In the preferred embodiment of the connector, the housing includes a fitting portion, a first side wall extending in the longitudinal direction and a second side wall extending in the short direction, which surround the fitting portion, the support portion includes a first support portion provided on the second side wall and a second support portion provided on the fitting portion, and in the fitting state with the mating connector, a mating support portion of the mating connector is fitted between the first support portion and the second support portion, so that the outer conductor shell is electrically connected to the mating outer conductor shell of the mating connector.

In the preferred embodiment of the connector, the outer conductor shell includes a side wall connecting portion provided on the first side wall near a corner in which the first side wall and the second side wall intersect, and in the fitting state with the mating connector, the side wall connecting portion contacts a mating side wall connecting portion of the mating connector, and the outer conductor shell is electrically connected to the mating outer conductor shell of the mating connector.

In the preferred embodiment of the connector, the housing includes a first outer wall that covers the first shield and a second outer wall that covers the second shield, and the shell mounting portion is exposed from the first outer wall or the second outer wall.

In the preferred embodiment of the connector, the plurality of terminals is provided along the first side wall, and the first shield faces the first side wall provided with the plurality of terminals at equal intervals in the short direction.

In the preferred embodiment of the connector, the first shield is an edge portion of the outer conductor shell bent at a right angle to the shell plane.

In the preferred embodiment of the connector, the shell plane extends in the longitudinal direction on both sides of the fitting portion, and two of the contact portions are provided on each of the shell planes extending in the longitudinal direction on both sides of the fitting portion.

In the preferred embodiment of the connector, the outer conductor shell has two cuts in the shell plane, and the two cuts are located point-symmetrically with respect to a central axis in the fitting direction.

In the preferred embodiment of the connector, the connector is a receptacle connector or a plug connector.

In the connector device and the connector, the shield for electromagnetically shielding the terminals of the plug connector and the shield for electromagnetically shielding the terminals of the receptacle connector are respectively formed by bending the edge portions of the shell planes at a right angle to the shell planes. The shield for electromagnetically shielding the terminals of the plug connector and the shield for electromagnetically shielding the terminals of the receptacle connector are electrically connected to each other, since the two planes contact each other by the contact portions extending from one plane to the other plane of the shell planes facing each other when the connectors are fitted to each other. This substantially removes the potential difference between the shields, so that a sufficient electromagnetic shielding effect can be obtained. Further, with such a structure, the double structure of the inner and outer shields, which hinders miniaturization of the connector, can be avoided in the connector device and the connector, so that the area occupied by the connector on the substrate can be reduced. As a result, the connector device and the connector can contribute to high-density mounting.

Embodiments of the present disclosure will be described with reference to the drawings below. In all the drawings for explaining the embodiments, the same members are denoted by the same reference numerals in principle and repeated description thereof will be omitted. The embodiments are described independently. This does not preclude combining components of the embodiments to form the connector.

Figure 2:
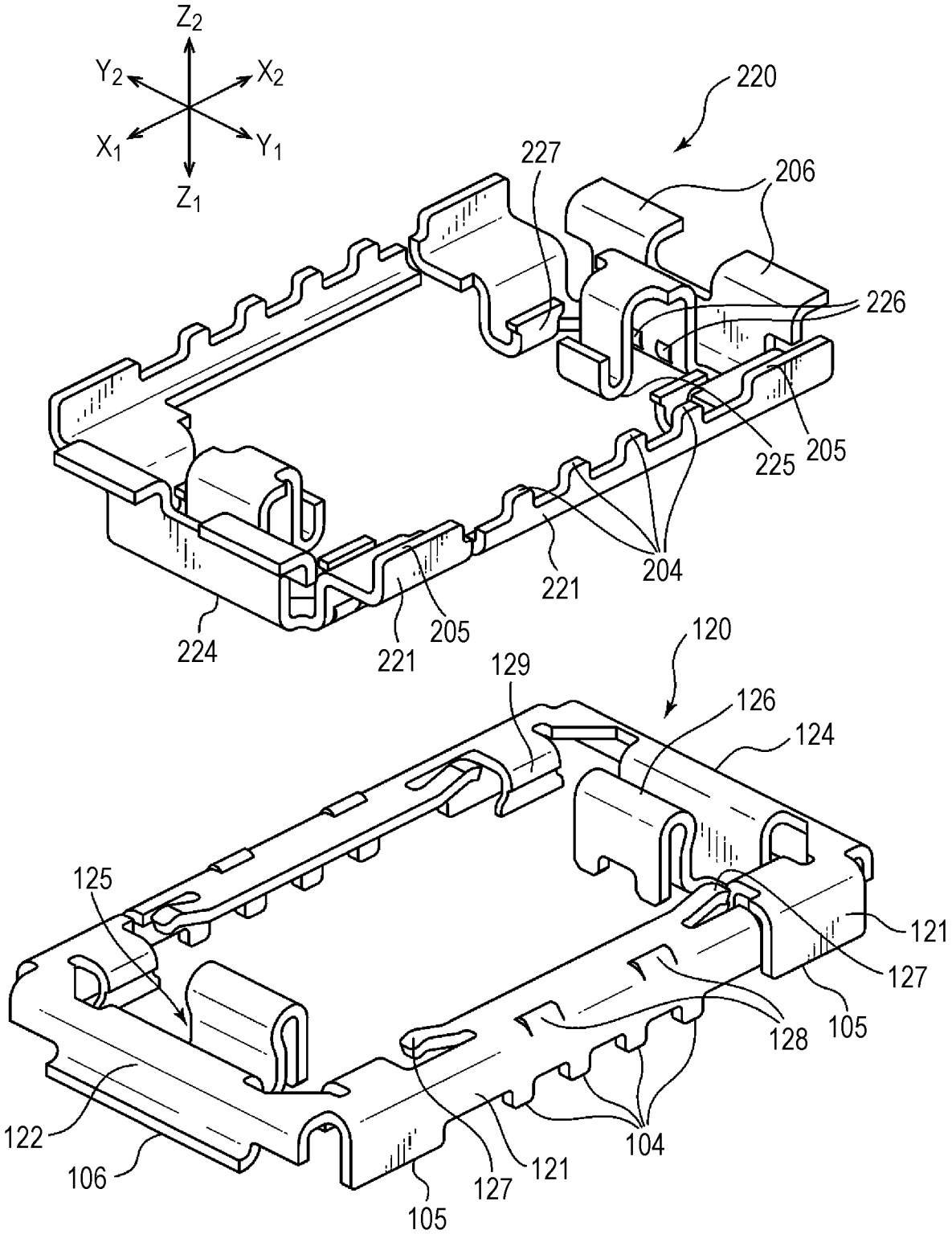
FIG. 2 is a diagram illustrating a shape of an outer conductor shell of each connector of the connector device illustrated in FIG. 1.
Figure 3:
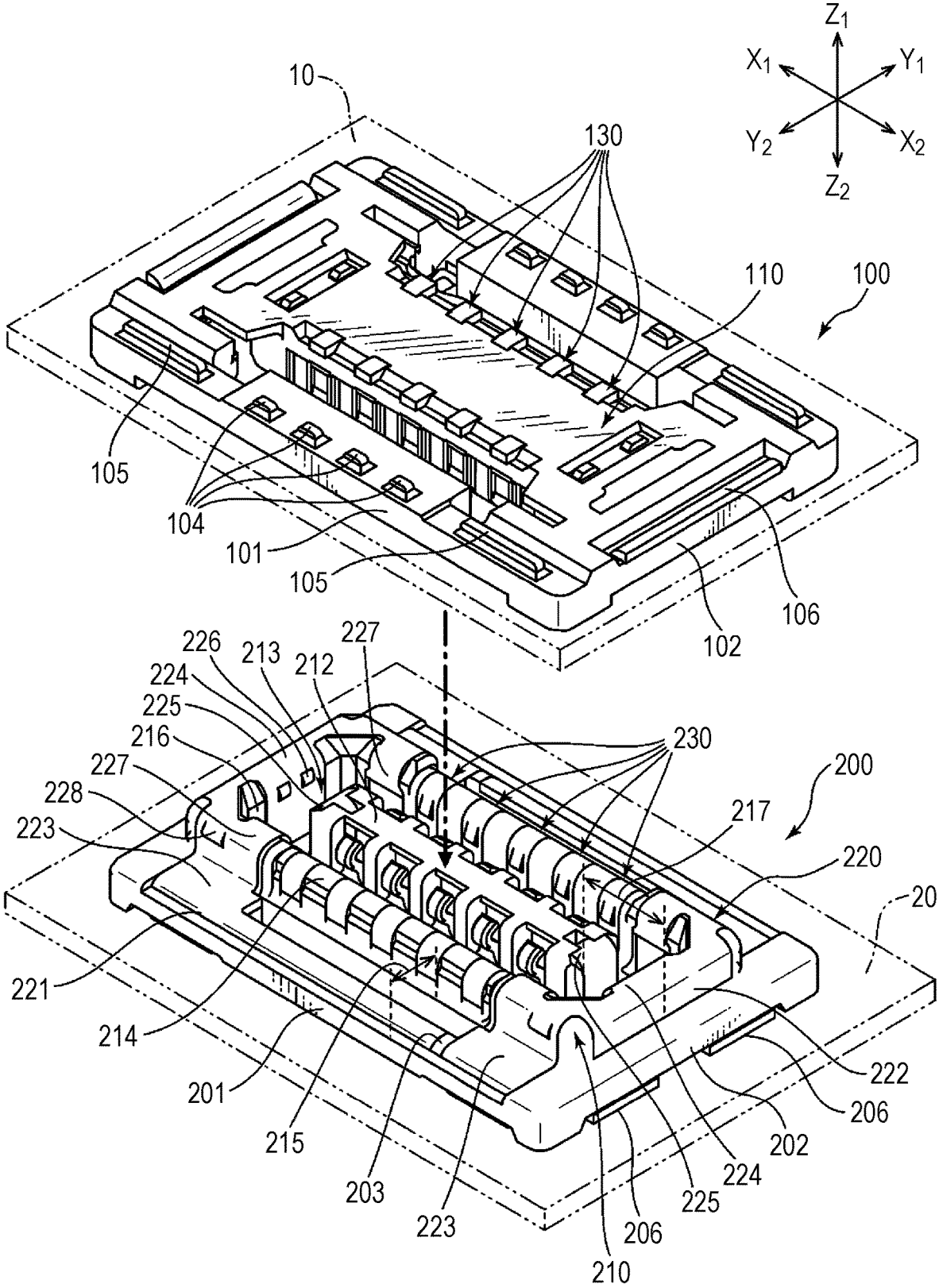
FIG. 3 is a diagram illustrating the connector device illustrated in FIG. 1 with its top and bottom reversed.
Figure 4:
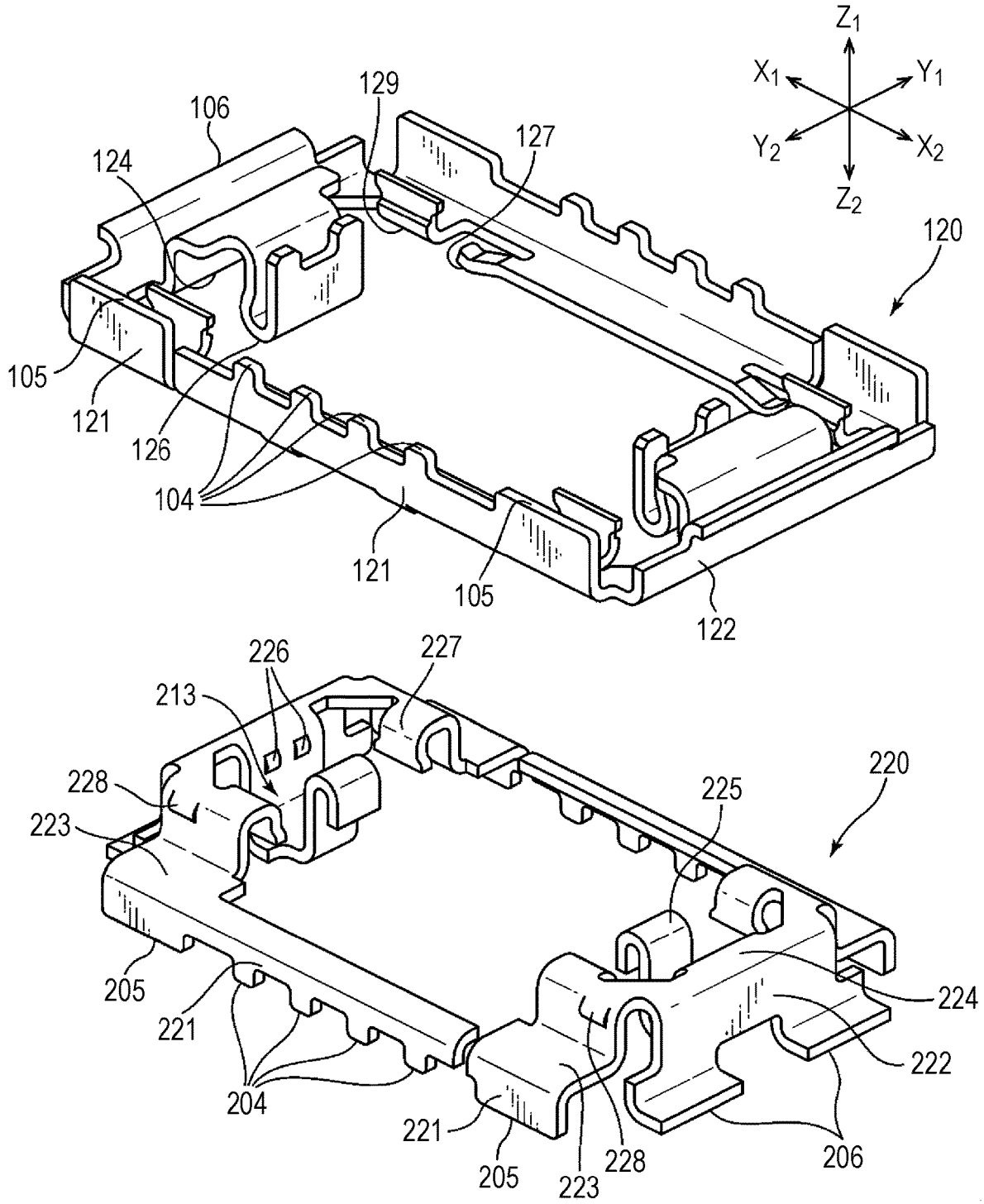
FIG. 4 is a diagram illustrating the shape of the outer conductor shell of each connector of the connector device illustrated in FIG. 3.

FIGS. 1 to 4 illustrate a connector device according to an embodiment of the present disclosure. FIG. 1 illustrates an appearance of the connector device when the plug connector side ($Z_1$ side) is viewed from the receptacle connector side ($Z_2$ side). FIG. 2 illustrates a shape of the outer conductor shells of the connectors of the connector device illustrated in FIG. 1. FIG. 3 illustrates the appearance of the connector device when the receptacle connector side ($Z_2$ side) is viewed from the plug connector side ($Z_1$ side) with its top and bottom reversed from FIG. 1. FIG. 4 illustrates the shape of the outer conductor shells of the connectors of the connector device illustrated in FIG. 3.

The fitting direction of the connector is the $Z_1$-$Z_2$ direction (Z-axis direction) in the drawings. A plug connector 100 is fitted with a receptacle connector 200 that is a mating connector on the $Z_2$ side in the Z-axis direction. The receptacle connector 200 is fitted with the plug connector 100 that is a mating connector on the $Z_1$ side in the Z axis direction. In the present embodiment, the longitudinal direction is the $X_1$-$X_2$ direction (X-axis direction) and the short direction is the $Y_1$-$Y_2$ direction (Y-axis direction). In FIG. 1, reference numerals "130" or "230" are given to some of the terminals in each of the plug connector 100 and the receptacle connector 200, and the reference numerals of the other terminals having the same shape are omitted. The above matters also apply to the other drawings.

The connector device illustrated in FIG. 1 includes the plug connector 100 and the receptacle connector 200. The connectors can be used as an internal component in a small electronic device such as a mobile phone, a smart phone, a digital camera, and a notebook computer.

The plug connector 100 and the receptacle connector 200 are mounted on the printed wiring board, a flexible flat cable or the like by soldering. Here, one on which the connector is mounted, such as the printed wiring board and the flexible flat cable, is simply referred to as a "substrate". In the connector device illustrated in FIG. 1, the plug connector 100 is mounted on a plug-side substrate 10 illustrated by broken lines. The receptacle connector 200 is mounted on a receptacle-side substrate 20 illustrated by broken lines. In the connector device, the plug connector, and the receptacle connector illustrated in FIG. 2 and subsequent drawings, illustration of the substrate is omitted. The plug connector 100 and the receptacle connector 200 are formed by molding a housing made of an insulating resin such as a liquid crystal polymer (LCP) into a rectangular shape.

Referring to FIG. 2 in conjunction with FIG. 1 and to FIG. 4 in conjunction with FIG. 3, the plug connector 100 includes a plurality of plug terminals 130, a plug housing 110 holding the plug terminals 130, and a plug shell 120 held by the plug housing 110. The plug connector 100 includes a recessed fitting recess 112 extending in the longitudinal direction (X-axis direction) in a central portion of the rectangular plug housing 110. The plug connector 100 includes first fitting side walls 114 that respectively hold the plug terminals 130 on both sides ($Y_1$ and $Y_2$ sides) of the fitting recess 112 in the short direction (Y-axis direction). The plug terminals 130 are made of metal such as phosphor bronze. The plug terminals 130 are respectively provided on the two first fitting side walls 114 extending in the longitudinal direction (X-axis direction) of the plug housing 110 and arranged at equal intervals.

Figure 5:
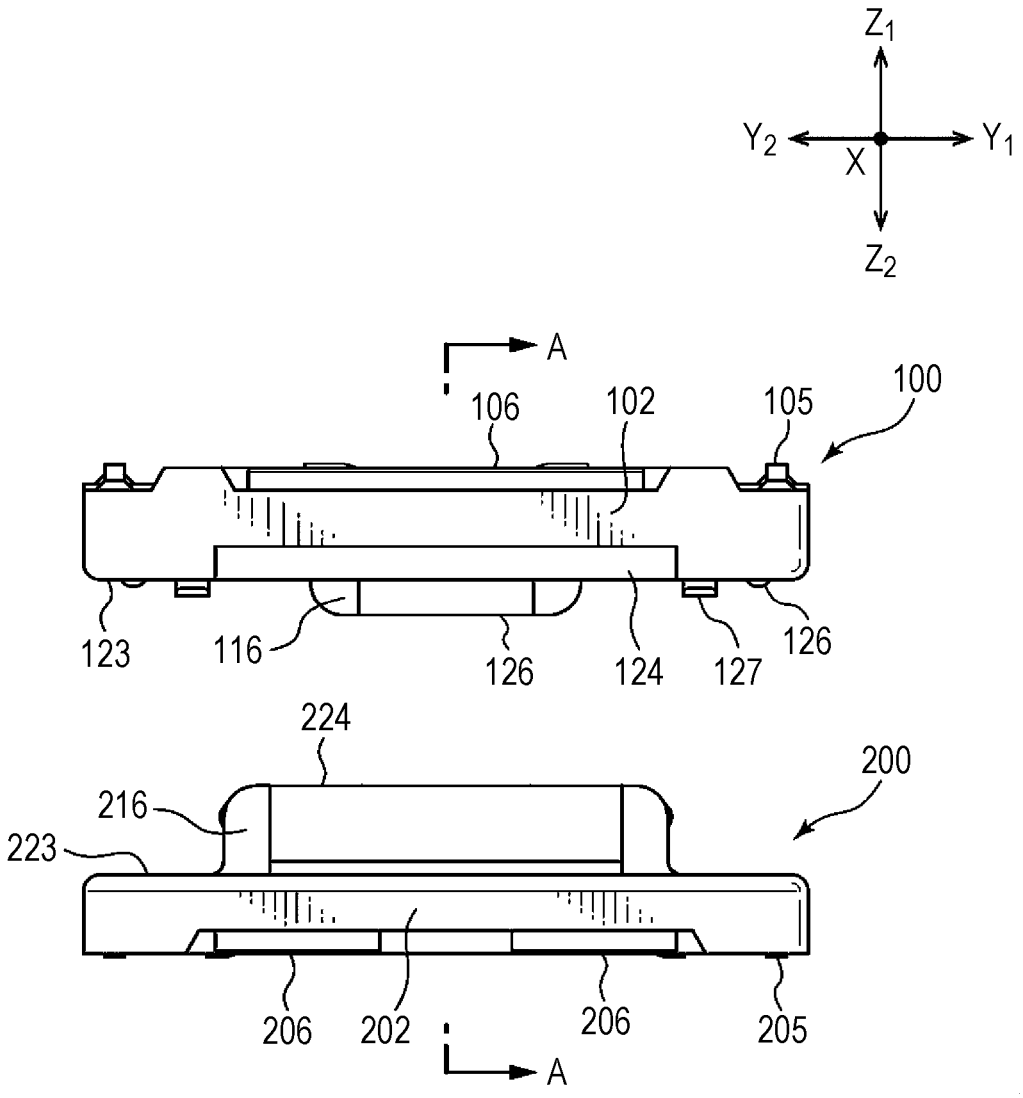
FIG. 5 is a diagram illustrating a line A-A for cutting the connector device illustrated in FIG. 3 along a central axis in its longitudinal direction.
Figure 6:
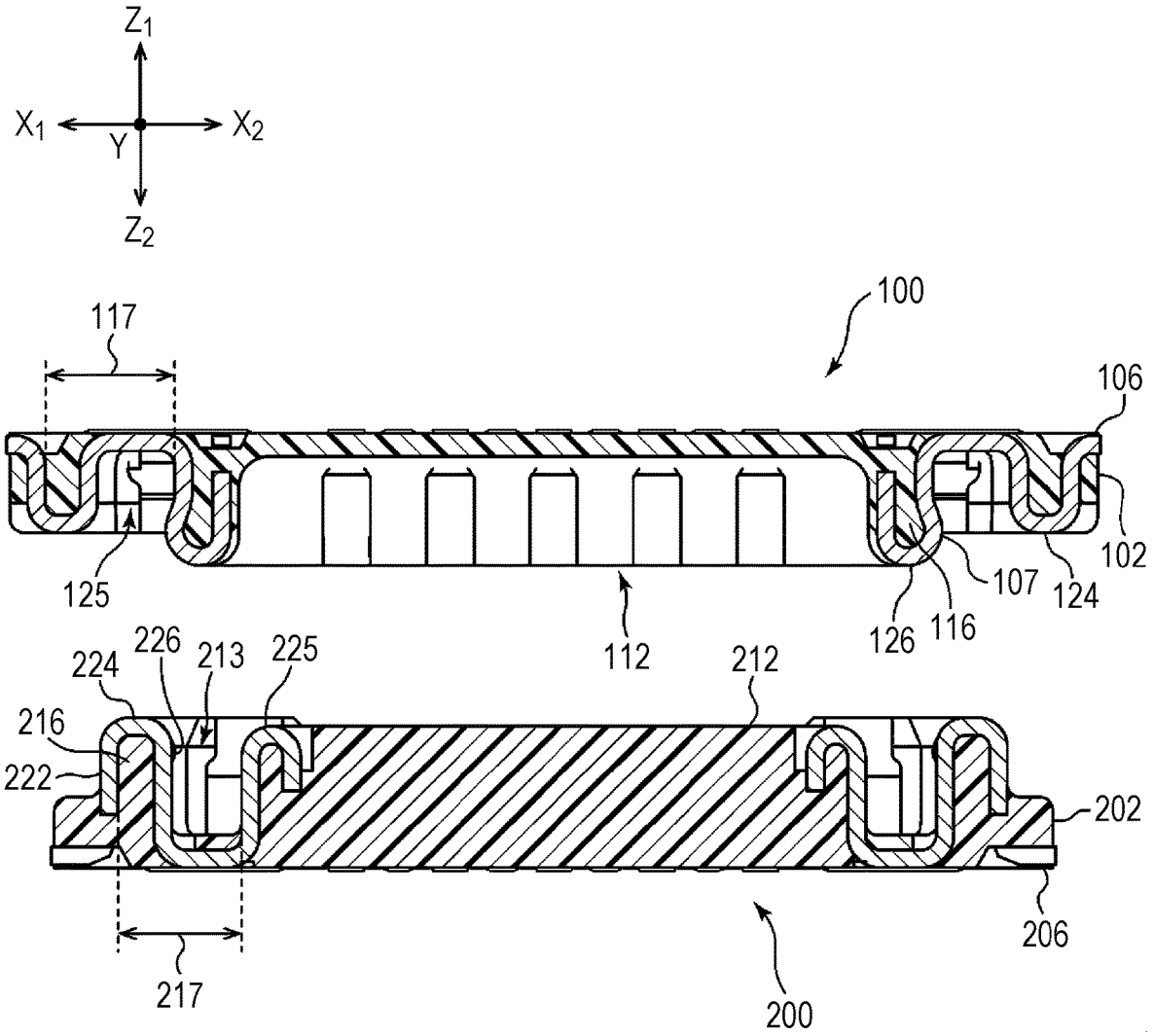
FIG. 6 is a cross-sectional view of the connector device cut in the longitudinal direction along the line A-A illustrated in FIG. 5 as seen from a short direction.

The connector device according to the embodiment of the present disclosure will be described with reference to FIGS. 5 to 9 in addition to FIGS. 1 to 4. FIG. 5 is a diagram of the connector device including the plug connector 100 and the receptacle connector 200 illustrated in FIG. 3, as viewed in the longitudinal direction (X-axis direction). A line A-A indicates a position in which the connector device is cut along a central axis in the longitudinal direction (X-axis direction). FIG. 6 is a cross-sectional view of the connector device cut in the longitudinal direction (X-axis direction) along the line A-A illustrated in FIG. 5 as seen from the short direction (Y-axis direction).

Figure 7:
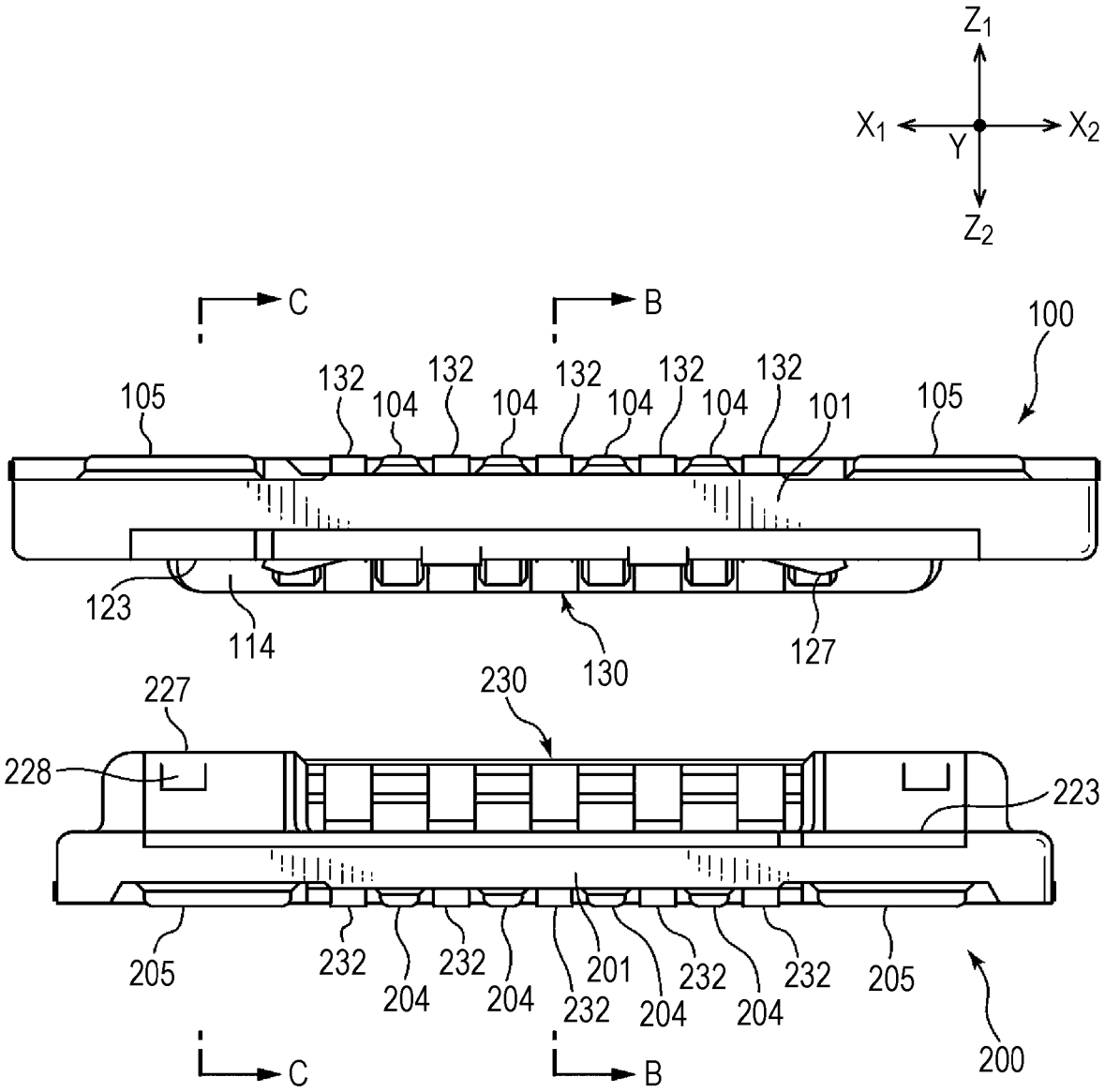
FIG. 7 is a diagram illustrating a line B-B for cutting the connector device illustrated in FIG. 3 along a central axis in the short direction, and a line C-C for cutting an end portion of the connector device in the short direction.
Figure 8:
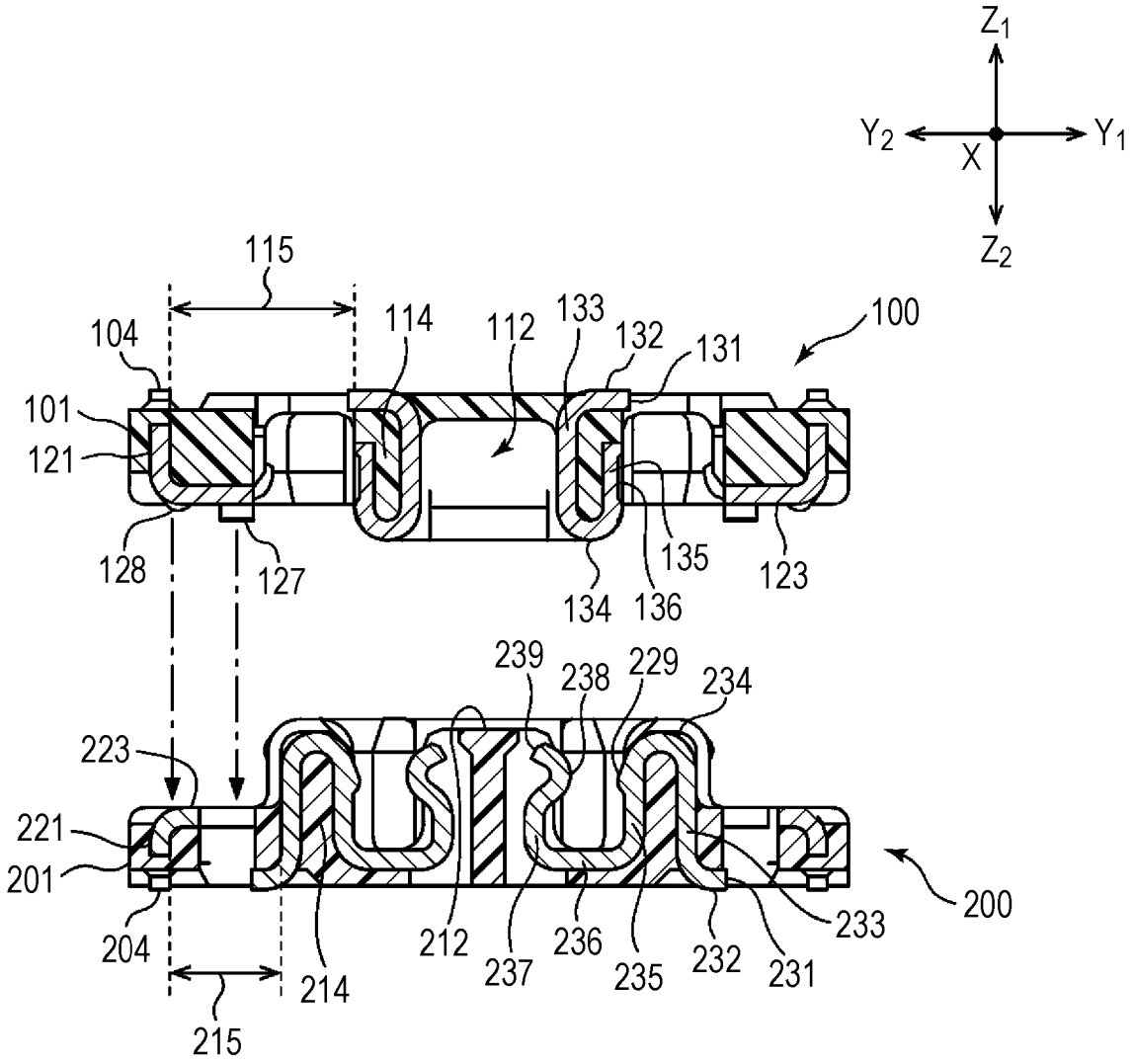
FIG. 8 is a cross-sectional view of the connector device cut in the short direction along the line B-B illustrated in FIG. 7.
Figure 9:
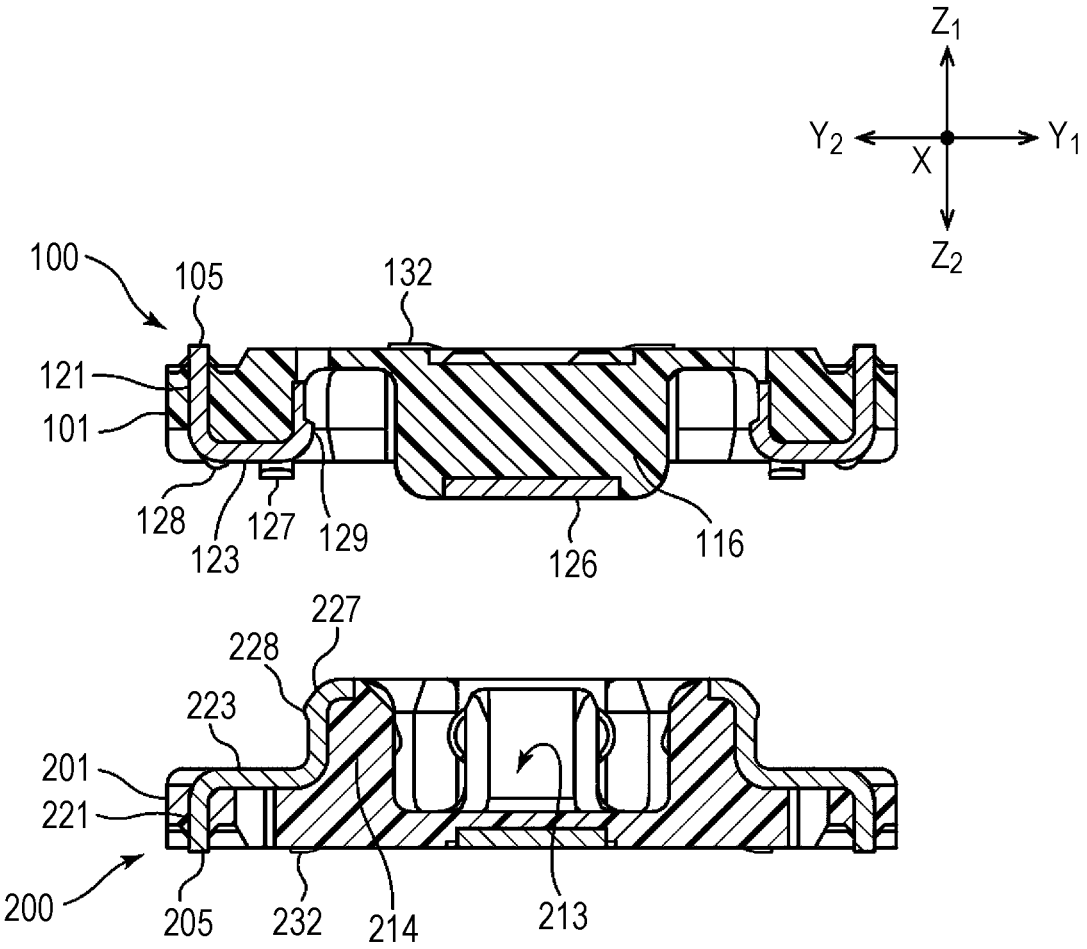
FIG. 9 is a cross-sectional view of the connector device cut in the short direction along the line C-C illustrated in FIG. 7.

FIG. 7 is a diagram of the connector device including the plug connector 100 and the receptacle connector 200 illustrated in FIG. 3 as seen from the short direction (Y-axis direction). A line B-B indicates a position in which the connector device is cut along a central axis in the short direction (Y-axis direction). A line C-C indicates a position in which the connector device is cut along the short direction (Y-axis direction) near a plug side wall connecting portion 129 and a receptacle side wall connecting portion 227. FIG. 8 is a cross-sectional view of the connector device cut in the short direction (Y-axis direction) along the line B-B illustrated in FIG. 7. FIG. 9 is a cross-sectional view of the connector device cut in the short direction (Y-axis direction) along the line C-C illustrated in FIG. 7.

Referring to FIGS. 1 and 8, the plug terminal 130 includes a substantially U-shaped curved portion including an inner fixing portion 133, a top portion 134, and an outer fixing portion 135. The inner fixing portion 133 and the outer fixing portion 135 are formed at positions facing each other inside the plug terminal 130. The plug terminal 130 is held by the plug housing 110 so as to wrap the first fitting side wall 114 in the longitudinal direction (X-axis direction) of the plug connector 100 with a mounting portion 132, the inner fixing portion 133, the top portion 134, and the outer fixing portion 135. Thus, the resin exists or is filled between the inner fixing portion 133 and the outer fixing portion 135, that is, inside the plug terminal 130.

The plug terminal 130 has the mounting portion 132 on the side ($Z_1$ side) mounted on the substrate. The mounting portion 132 extends outward in the short direction (Y-axis direction) of the plug connector 100 via a curved portion from the inner fixing portion 133, and is mounted (soldered) on the substrate. The outside in the short direction (Y-axis direction) described above is the $Y_2$ side if the inner fixing portion 133 is on the $Y_1$ side, and is the $Y_1$ side if the inner fixing portion 133 is on the $Y_2$ side.

A mounting end 131 that is an end of the mounting portion 132 faces a first plug shield 121. The mounting end 131 of the plug terminal 130 held by the first fitting side wall 114 on one side (for example, the $Y_1$ side) of the plug housing 110 faces the first plug shield 121 on the same side ($Y_1$ side). The mounting end 131 of the plug terminal 130 held by the first fitting side wall 114 on the other side (for example, the $Y_2$ side) of the plug housing 110 faces the first plug shield 121 on the same side ($Y_2$ side). When the plug connector 100 and the receptacle connector 200 are fitted to each other, the plug shell 120 and a receptacle shell 220 are arranged without overlapping each other in the short direction (Y-axis direction). The plug shell 120 and the receptacle shell 220 are electrically connected to each other. Here, the plug shell 120 and the receptacle shell 220 are arranged not to overlap each other in the short direction (Y-axis direction) means that the plug shell 120 and the receptacle shell 220 are arranged not to include a state in which they face each other and are in contact with each other in the short direction (Y-axis direction).

By insert molding of the plug terminal 130 and the plug housing 110, the inner fixing portion 133 and the top portion 134 of the plug terminal 130 are embedded in the first fitting side wall 114 so that a side surface of the inner fixing portion 133 and a side surface of the top portion 134 form substantially the same surface with a surface of the first fitting side wall 114. The outer fixing portion 135 includes a contact portion 136 in order to contact the receptacle terminal 230 that is a mating terminal. The contact portion 136 is formed by recessing a surface on the outer side in the short direction (Y-axis direction). The outer side in the short direction (Y-axis direction) described above is the $Y_1$ side if the inner fixing portion 133 is on the $Y_1$ side, and is the $Y_2$ side if the inner fixing portion 133 is on the $Y_2$ side.

The surface of the inner fixing portion 133 of the plug terminal 130 functions as a contact portion that contacts the receptacle terminal 230, and can contact a contact portion 238 provided on the receptacle terminal 230 with a contact pressure. Further, the contact portion 136 provided on the outer fixing portion 135 of the plug terminal 130 can contact a contact protrusion 229 provided on a fixing portion 235 of the receptacle terminal 230.

Two rows of the first fitting side walls 114 are provided in the longitudinal direction (X-axis direction) of the plug connector 100. The fitting recess 112 is formed between the two rows of the first fitting side walls 114. That is, the fitting recess 112 is formed to be surrounded by the first fitting side walls 114 extending in the longitudinal direction (X-axis direction) and second fitting side walls 116 extending in the short direction (Y-axis direction).

The plug housing 110 of the plug connector 100 can hold the plug terminals 130 by being insert-molded (integrally molded) with the plug terminals 130 having the same shape. The plug terminals 130 are arranged in two rows in the longitudinal direction (X-axis direction) at substantially equal intervals. The plug housing 110 includes first plug side walls 118 extending in the longitudinal direction (X-axis direction) and second plug side walls 119 extending in the short direction (Y-axis direction), which surround the first fitting side walls 114 and the second fitting side walls 116 of the fitting recess 112.

The plug shell 120 that is the outer conductor shell includes the plate-like first plug shields 121 extending in the longitudinal direction (X-axis direction) of the plug housing 110, and second plug shields 122 extending in the short direction (Y-axis direction) of the plug housing 110. The plug shell 120 includes the first plug shields 121 on both sides (the $Y_1$ and $Y_2$ sides). The first plug shield 121 is divided by a partition 103 of the plug housing 110 (a cut of the plug shell 120). The first plug shield 121 is formed of two shields divided on one side (the $Y_1$ or $Y_2$ side). However, the first plug shield 121 may be formed of one shield or may be formed of a plurality of further divided shields. The first plug shield 121 has a plane parallel to the X-Z plane, and is disposed over a wider range than the first fitting side wall 114 in the longitudinal direction (X-axis direction).

The plug shell 120 includes the second plug shields 122 in addition to the first plug shields 121. The plug shell 120 includes plate-like second plug shields 122 extending in the short direction (Y-axis direction) of the plug housing 110, one on each side ($X_1$ and $X_2$ sides). In the present embodiment, one second plug shield 122 is formed on one side (the $Y_1$ or $Y_2$ side). Alternatively, the plug shell 120 may have a plurality of shields formed by dividing one shield. On an edge portion of the first plug shield 121, plug shell mounting portions 104 and 105 for mounting on a ground portion (not shown) of the substrate are formed. On an edge portion of the second plug shield 122, a plug shell mounting portion 106 for mounting on the ground portion (not shown) of the substrate is formed. The plug shell mounting portions 104, 105 and 106 can set a potential of the plug shell 120 to a ground potential. The second plug shield 122 has a plane parallel to the Y-Z plane, and is disposed over a wider range than the second fitting side wall 116 in the short direction (Y-axis direction). When the plug connector 100 and the receptacle connector 200 are fitted to each other, the plug shell 120 is electrically connected to the receptacle shell 220 that is the mating outer conductor shell.

Referring to FIGS. 6 and 8 in addition to FIG. 1, a circumference (circumference on the X-Y plane) of the fitting recess 112 of the plug housing 110 is surrounded by the first plug shield 121 and the second plug shield 122 with a first interval 115 and a second interval 117. The first interval 115 is an interval from the first fitting side wall 114 of the plug housing 110 to the first plug shield 121. The second interval 117 is an interval from the second fitting side wall 116 of the plug housing 110 to the second plug shield 122. The first fitting side wall 114 and the first plug shield 121 are parallel to each other, and the second fitting side wall 116 and the second plug shield 122 are parallel to each other. Therefore, the first interval 115 and the second interval 117 are substantially constant values. The first plug shield 121 faces the plug terminals 130 exposed from the plug housing 110 at substantially equal intervals in the short direction (Y-axis direction). More specifically, the first plug shield 121 faces the outer fixing portions 135 (see FIG. 8) of the plug terminals 130 at substantially equal intervals in the short direction (Y-axis direction).

The plug shell 120 includes plug shell planes 123 extending in the longitudinal direction (X-axis direction) of the plug housing 110 on both sides (the $Y_1$ and $Y_2$ sides). The first plug shield 121 is an edge portion of the plug shell 120 that is bent at a right angle to the plug shell plane 123. The plug shell 120 that is the outer conductor shell has two cuts (the partitions 103 of the plug housing 110) in the plug shell planes 123. The two cuts (the partitions 103 of the plug housing 110) are located point-symmetrically with respect to a central axis in the fitting direction (Z-axis direction).

The plug shell plane 123 extends in the longitudinal direction on both sides (the $Y_1$ and $Y_2$ sides) of the fitting recess 112 on the X-Y plane. The plug shell plane 123 faces a mating shell plane (receptacle shell plane 223) of the receptacle connector 200 that is the mating connector when the connectors are fitted together. The plug shell plane 123 is formed of two shell planes divided on one side (the $Y_1$ or $Y_2$ side) by the partition 103 of the plug housing 110 (the cut of the plug shell 120). Alternatively, the plug shell plane 123 may be formed of one shell plane or may be formed of a plurality of further divided shell planes. The plug shell plane 123 has a plane parallel to the X-Y plane, and is disposed over a wider range than the first fitting side wall 114 in the longitudinal direction (X axis direction).

Referring to FIGS. 1 and 8, the plug shell plane 123 includes a contact portion 127 that is a contact piece having elasticity. The contact portion 127 extends in the longitudinal direction (X-axis direction) from the plug shell plane 123. The contact portion 127 is formed by being bent in the fitting direction ($Z_2$ side in the Z-axis direction) with the receptacle connector 200 that is the mating connector. The contact portion 127 is configured to contact the mating shell plane (receptacle shell plane 223) of the receptacle connector 200 that is the mating connector when the connectors are fitted to each other (an arrow in FIG. 8). When the plug connector 100 and the receptacle connector 200 are fitted to each other, the plug shell 120 and the receptacle shell 220 are electrically connected to each other via at least the contact portion 127. The contact portion 127 is not limited to the contact piece. The contact portion 127 only needs to have a configuration capable of maintaining an electrical connection when the connectors are fitted to each other.

In the embodiment of the present disclosure, two contact portions 127 are provided on each of the plug shell planes 123 extending in the longitudinal direction (X-axis direction) on both sides of the fitting recess 112. An installation state of the contact portion 127 is not limited to this. Only one contact portion 127 may be provided on the plug shell plane 123 on one side (the $Y_1$ or $Y_2$ side). Alternatively, three or more contact portions 127 may be provided thereon. Further, the contact portion 127 may be provided on the receptacle shell plane 223 of the receptacle shell 220 instead of the plug shell plane 123. That is, one or more contact portions 127 may be provided on one shell plane out of the plug shell plane 123 and the receptacle shell plane 223, to contact the other shell plane. Further, the contact portions 127 may be provided on both the plug shell plane 123 and the receptacle shell plane 223.

The contact portion 127 may be, for example, the contact piece having elasticity. In this case, the contact portion 127 is configured to contact the receptacle shell plane 223 that is the mating shell plane to be pushed down, when the connectors are fitted to each other. The plug connector 100 including the plug shell plane 123 provided with the contact portion 127 has a space for accommodating the contact portion 127 that is formed by removing the first plug side wall 118 near the partition 103 and is pushed down by the mating shell plane. The same structure is used even when the contact portion is provided on the receptacle shell plane 223.

Referring again to FIGS. 1 and 8, the plug shell plane 123 includes a protrusion 128 formed protruding from the surface. The protrusion 128 can be configured to contact the receptacle shell plane 223 of the receptacle connector 200 that is the mating connector, when the plug connector 100 and the receptacle connector 200 are fitted to each other (an arrow in FIG. 8). The protrusion 128 may be provided on the receptacle shell plane 223 of the receptacle shell 220 instead of the plug shell plane 123. The protrusion 128 may also be provided on both the plug shell plane 123 and the receptacle shell plane 223.

The plug shell 120 includes plug housing support portions including a first plug housing support portion 124 and a second plug housing support portion 126, which extend along the side walls in the short direction (Y-axis direction) of the plug housing 110, one on each side (the $X_1$ and $X_2$ sides). The first plug housing support portion 124 is provided on the second plug side wall 119. The second plug housing support portion 126 is provided on the second fitting side wall 116. A plug shell connecting portion 125 is a portion sandwiched between the first plug housing support portion 124 and the second plug housing support portion 126. When the plug connector 100 and the receptacle connector 200 are fitted to each other, a first receptacle housing support portion 224 is fitted between the first plug housing support portion 124 and the second plug housing support portion 126, so that the plug shell 120 and the receptacle shell 220 are electrically connected to each other. In the embodiment illustrated in FIGS. 1 and 2, the plug housing support portion including the first plug housing support portion 124 and the second plug housing support portion 126 is provided along the side wall in the short direction (Y-axis direction). However, an installation position of the plug housing support portion is not limited to this. The plug housing support portion can be provided at any position as long as it is held by the plug housing.

The first plug housing support portion 124, the plug shell connecting portion 125, and the second plug housing support portion 126 are formed in a portion extending from a central portion of the second plug shield 122 toward the fitting recess 112. The plug shell connecting portion 125 is located between the second plug side wall 119 and the second fitting side wall 116, which extend in the short direction (Y-axis direction) of the plug housing 110. Specifically, the plug shell connecting portion 125 is located between the first plug housing support portion 124 provided on the second plug side wall 119 of the plug housing 110 and the second plug housing support portion 126 provided on the second fitting side wall 116. In the embodiment illustrated in FIGS. 1 and 2, the plug shell connecting portion 125 has a recessed shape. However, the shape of the plug shell connecting portion 125 is not limited to this, but may be protruding. The shape of the plug shell connecting portion 125 may be any shape as long as the plug shell connecting portion 125 can be fitted to receptacle housing support portions (224, 225) of the receptacle connector 200.

The receptacle connector 200 includes a plurality of the receptacle terminals 230, a receptacle housing 210 that holds the receptacle terminals 230, and the receptacle shell 220 that is held by the receptacle housing 210. The receptacle connector 200 includes a protruding fitting protrusion 212 extending in the longitudinal direction (X-axis direction) at a central portion of the rectangular receptacle housing 210. The receptacle connector 200 includes first receptacle side walls 214 that respectively hold the receptacle terminals 230 on both sides (the $Y_1$ and $Y_2$ sides) in the short direction (Y-axis direction) of the fitting protrusion 212. The receptacle terminals 230 are made of metal such as phosphor bronze. The receptacle terminals 230 are respectively provided on the two first receptacle side walls 214 extending in the longitudinal direction (X-axis direction) of the receptacle housing 210 and arranged at equal intervals.

Referring to FIGS. 1 and 8, the receptacle terminal 230 includes a movable portion 237 on the fitting protrusion 212 side. The movable portion 237 is a free end extending in the fitting direction (Z-axis direction) with the mating connector, and has elasticity. The movable portion 237 has the contact portion 238 that contacts the inner fixing portion 133 of the plug terminal 130, and a movable end portion 239 that is located at an end of the contact portion 238 and faces the fitting protrusion 212. Further, the receptacle terminal 230 includes a top portion 234, a leg portion 233, and the fixing portion 235. The top portion 234 is held by the first receptacle side wall 214 in the longitudinal direction (X-axis direction) of the receptacle connector 200. The leg portion 233 and the fixing portion 235 form an upside down U-shaped portion around the top portion 234. The fixing portion 235 and the movable portion 237 form a U-shaped portion around the bottom portion 236.

The receptacle terminal 230 has a mounting portion 232 on a side mounted on the board ($Z_2$ side). The mounting portion 232 extends outward in the short direction (Y-axis direction) of the receptacle connector 200 via a curved portion from the leg portion 233, and is mounted (soldered) on the substrate. The outside in the short direction (Y-axis direction) of the receptacle connector 200 described above is the $Y_1$ side if the leg portion 233 is on the $Y_1$ side, and is the $Y_2$ side if the leg portion 233 is on the $Y_2$ side.

A mounting end 231 that is an end of the mounting portion 232 faces a first receptacle shield 221. The mounting end 231 of the receptacle terminal 230 held by the first receptacle side wall 214 on one side (for example, the $Y_1$ side) of the receptacle housing 210 faces the first receptacle shield 221 on the same side (the $Y_1$ side). The mounting end 231 of the receptacle terminal 230 held by the first receptacle side wall 214 on the other side (for example, the $Y_2$ side) of the receptacle housing 210 faces the first receptacle shield 221 on the same side (the $Y_2$ side).

By insert molding of the receptacle terminal 230 and the receptacle housing 210, the bottom portion 236, the fixing portion 235, the top portion 234, and the leg portion 233 of the receptacle terminal 230 are held by the first receptacle side wall 214 and its peripheral portion in the longitudinal direction (X-axis direction) of the receptacle housing 210. A back surface of the top portion 234 of the receptacle terminal 230 (a surface facing the first receptacle side wall 214), a back surface of the fixing portion 235 (a surface facing the leg portion 233), and a back surface of the leg portion 233 (a surface facing the fixing portion 235) are embedded in and held by the first receptacle side wall 214, so that a surface of the upside-down U-shaped portion exposed from the first receptacle side wall 214 is flush with a surface of the first receptacle side wall 214.

The movable portion 237 of the receptacle terminal 230 has the contact portion 238 formed to project to the fixing portion 235 side at its tip portion. The contact portion 238 can contact the inner fixing portion 133 of the plug terminal 130 with a contact pressure, when the plug connector 100 and the receptacle connector 200 are fitted to each other (when fitted with the plug connector 100). Further, the fixing portion 235 of the receptacle terminal 230 is configured such that the contact protrusion 229 formed to project from the surface on the movable portion 237 side can contact the recessed contact portion 136 of the plug terminal 130 with a contact pressure, in a fitting state with the plug connector 100.

Two rows of the first receptacle side walls 214 are provided in the longitudinal direction (X-axis direction) of the receptacle connector 200. The fitting protrusion 212 is formed between the two rows of the first receptacle side walls 214. That is, the fitting protrusion 212 is formed to be surrounded by the first receptacle side walls 214 extending in the longitudinal direction (X-axis direction) and second receptacle side walls 216 extending in the short direction (Y-axis direction).

The receptacle housing 210 of the receptacle connector 200 is insert-molded (integrally molded) with the receptacle terminals 230 having the same shape arranged in two rows in the longitudinal direction (X-axis direction) at substantially equal intervals. Thus, the receptacle housing 210 can hold the receptacle terminals 230.

The receptacle shell 220 that is the outer conductor shell includes a plate-like first receptacle shield 221 extending in the longitudinal direction (X-axis direction) of the receptacle housing 210, and a second receptacle shield 222 extending in the short direction (Y-axis direction) of the receptacle housing 210. The receptacle shell 220 includes the first receptacle shields 221 on both sides (the $Y_1$ and $Y_2$ side). The first receptacle shield 221 is divided by a partition 203 of the receptacle housing 210 (a cut of the receptacle shell 220). The first receptacle shield 221 is formed of two shields divided on one side (the $Y_1$ or $Y_2$ side). However, the first receptacle shield 221 may be formed of one shield or may be formed of a plurality of further divided shields. The first receptacle shield 221 has a plane parallel to the X-Z plane, and is disposed over a wider range than the fitting protrusion 212 in the longitudinal direction (X-axis direction).

The receptacle shell 220 includes the second receptacle shields 222 in addition to the first receptacle shields 221. The receptacle shell 220 includes plate-like second receptacle shields 222 extending in the short direction (Y-axis direction) of the receptacle housing 210, one on each side (the $X_1$ and $X_2$ sides). In the present embodiment, one second receptacle shield 222 is formed on one side (the $Y_1$ or $Y_2$ side). Alternatively, the receptacle shell 220 may have a plurality of shields formed by dividing one shield. Receptacle shell mounting portions 204 and 205 for mounting on a ground portion (not shown) of the substrate are formed on the edge portion of the first receptacle shield 221. On the edge portion of the second receptacle shield 222, a receptacle shell mounting portion 206 for mounting on the ground portion (not shown) of the substrate is formed. The receptacle shell mounting portions 204, 205 and 206 can set the potential of the receptacle shell 220 to the ground potential. The second receptacle shield 222 has a plane parallel to the Y-Z plane, and is disposed over a wider range than the fitting protrusion 212 in the short direction (Y axis direction). When the plug connector 100 and the receptacle connector 200 are fitted to each other, the receptacle shell 220 is electrically connected to the plug shell 120 that is the mating outer conductor shell.

The first receptacle side wall 214 and the second receptacle side wall 216 surround a circumference of the fitting protrusion 212 of the receptacle housing 210. The first receptacle side wall 214 and the second receptacle side wall 216 are further surrounded by the first receptacle shield 221 and the second receptacle shield 222 with a first interval 215 and a second interval 217. The first interval 215 is an interval from the first receptacle side wall 214 of the receptacle housing 210 to the first receptacle shield 221. The second interval 217 is an interval from the second receptacle side wall 216 of the receptacle housing 210 to the second receptacle shield 222. The first receptacle side wall 214 and the first receptacle shield 221 are parallel to each other. The second receptacle side wall 216 and the second receptacle shield 222 are parallel to each other. Therefore, the first interval 215 and the second interval 217 are substantially constant values. The first receptacle shield 221 faces the receptacle terminals 230 exposed from the receptacle housing 210 at substantially equal intervals in the short direction (Y-axis direction). More specifically, the first receptacle shield 221 faces the leg portions 233 (see FIG. 8) of the receptacle terminals 230 in the short direction (Y-axis direction) at substantially equal intervals.

The receptacle shell 220 includes receptacle shell planes 223 extending in the longitudinal direction (X-axis direction) of the receptacle housing 210 on both sides (the $Y_1$ and $Y_2$ sides). The first receptacle shield 221 is an edge portion of the receptacle shell 220 bent at a right angle to the receptacle shell plane 223. The receptacle shell 220 that is the outer conductor shell has two cuts (the partitions 203 of the receptacle housing 210) in the receptacle shell plane 223. The two cuts (the partitions 203 of the receptacle housing 210) are located point-symmetrically with respect to the central axis in the fitting direction (Z-axis direction).

The receptacle shell planes 223 extend in the longitudinal direction along the first receptacle side walls 214 on both sides (the $Y_1$ and $Y_2$ sides) of the fitting protrusion 212 on the X-Y plane. The receptacle shell plane 223 faces the mating shell plane (plug shell plane 123) of the plug connector 100 that is the mating connector when the connectors are fitted to each other. The receptacle shell plane 223 is formed of two shell planes divided on one side (the $Y_1$ or $Y_2$ side) by the partition 203 of the receptacle housing 210 (the cut of the receptacle shell 220). Alternatively, the receptacle shell plane 223 may be formed of one shell plane, or may be formed of a plurality of further divided shell planes. The receptacle shell plane 223 has a plane parallel to the X-Y plane, and is disposed over a wider range than the fitting protrusion 212 in the longitudinal direction (X-axis direction).

The receptacle shell 220 has plug housing support portions including the first receptacle housing support portion 224 and the second receptacle housing support portion 225, which extend along the side wall in the short direction (Y-axis direction) of the receptacle housing 210, one on each side (the $X_1$ and $X_2$ sides). The first receptacle housing support portion 224 is provided on the second receptacle side wall 216. The second receptacle housing support portion 225 is provided on the fitting protrusion 212. A receptacle shell connecting portion 213 is a portion sandwiched between the first receptacle housing support portion 224 and the second receptacle housing support portion 225. When the plug connector 100 and the receptacle connector 200 are fitted to each other, the second plug housing support portion 126 is fitted between the first receptacle housing support portion 224 and the second receptacle housing support portion 225, so that the receptacle shell 220 and the plug shell 120 are electrically connected to each other. In the embodiment illustrated in FIGS. 3 and 4, the receptacle housing support portion including the first receptacle housing support portion 224 and the second receptacle housing support portion 225 is provided along the side wall in the short direction (Y-axis direction). However, an installation position of the receptacle housing support portion is not limited to this. The receptacle housing support portion can be provided at any position as long as it is held by the receptacle housing.

The first receptacle housing support portion 224, the receptacle shell connecting portion 213, and the second receptacle housing support portion 225 are formed in a portion extending from a central portion of the second receptacle shield 222 toward the fitting protrusion 212. The receptacle shell connecting portion 213 is located between the second receptacle side wall 216 extending in the short direction (Y-axis direction) of the receptacle housing 210 and the fitting convex portion 212. Specifically, the receptacle shell connecting portion 213 is located between the first receptacle housing support portion 224 provided on the second receptacle side wall 216 of the receptacle housing 210 and the second receptacle housing support portion 225 provided on the fitting protrusion 212. In the embodiment illustrated in FIGS. 3 and 4, the receptacle shell connecting portion 213 has a recessed shape. However, the shape of the receptacle shell connecting portion 213 is not limited to this, but may be protruding. The shape of the receptacle shell connection portion 213 may be any shape as long as the receptacle shell connection portion 213 can be fitted to the plug housing support portions (124, 126) of the plug connector 100.

The first receptacle housing support 224 can include a protruding contact point 226 on a contact surface with the second plug housing support 126. Similarly, the second receptacle housing support portion 225, the first plug housing support portion 124, and the second plug housing support portion 126, which are other housing support portions, can also include contacts 228 protruding from contact surfaces with the mating support portions.

As illustrated in FIGS. 1 and 2, the plug shell 120 includes the plug side wall connecting portion 129 provided on the first plug side wall 118 near a corner in which the first plug side wall 118 and the second plug side wall 119 intersect. As illustrated in FIGS. 3 and 4, the receptacle shell 220 includes the receptacle side wall connecting portion 227 provided on the first receptacle side wall 214 near a corner in which the first receptacle side wall 214 and the second receptacle side wall 216 intersect. Referring also to FIG. 9, when the plug connector 100 and the receptacle connector 200 are fitted to each other, the plug side wall connecting portion 129 and the receptacle side wall connecting portion 227 contact each other, so that the plug shell 120 and the receptacle shell 220 are electrically connected to each other. The receptacle side wall connection portion 227 can include a contact point 228 protruding from a contact surface with the plug side wall connection portion 129. Similarly, the plug side wall connecting portion 129 can also include a contact point 228 protruding from a contact surface with the receptacle side wall connecting portion 227.

As illustrated in FIGS. 1, 3 and 9, the plug housing 110 includes a first plug outer wall 101 that covers the first plug shield 121 and a second plug outer wall 102 that covers the second plug shield 122. The plug shell mounting portions 104 and 105 are exposed from the first plug outer wall 101. The plug shell mounting portion 106 is exposed from the second plug outer wall 102. The receptacle housing 210 includes a first receptacle outer wall 201 that covers the first receptacle shield 221 and a second receptacle outer wall 202 that covers the second receptacle shield 222. The receptacle shell mounting portions 204 and 205 are exposed from the first receptacle outer wall 201. The receptacle shell mounting portion 206 is exposed from the second receptacle outer wall 202.

Referring to FIG. 7, when viewed in the short direction (Y-axis direction), the plug shell mounting portion 104 is disposed between the mounting portions 132 of the plug terminals 130, and the receptacle shell mounting portion 204 is disposed between the mounting portions 232 of the receptacle terminals 230.

In the present specification and claims, two connectors included in the connector device are referred to as the plug connector and the receptacle connector in order to distinguish them from each other. Further, members, components or the like are referred to as the plug housing and the receptacle housing, the plug terminal and the receptacle terminal, the plug shell and the receptacle shell, the plug shield and the receptacle shield, and the plug shell plane and the receptacle shell plane. In this regard, when the two connectors are not distinguished by a shape of the connector, expressions "plug" and "receptacle" are omitted, and the members, components or the like are simply referred to as the connector, the housing, the terminal, the shell (or the outer conductor shell), the shield, the shell plane, and the like.

When the two connectors are not distinguished by the shape of the connector, the first fitting side wall and the first receptacle side wall, the second fitting side wall and the second receptacle side wall, the first plug outer wall and the first receptacle outer wall, the second plug outer wall and the second receptacle outer wall, and the fitting recess and the fitting protrusion are simply referred to as the first side wall, the second side wall, the first outer wall, the second outer wall, and the fitting portion. Further, the first plug housing support portion and the first receptacle housing support portion, the second plug housing support portion and the second receptacle housing support portion, and the plug side wall connecting portion and the receptacle side wall connecting portion are simply referred to as the first support portion, the second support portion, and the side wall connecting portion. Regarding the first plug housing support portion and the second plug housing support portion, the first receptacle housing support portion and the second receptacle housing support portion, the first support portion and the second support portion, and the like, expressions "first" and "second" are omitted, and they may be simply referred to as the plug housing support portion, the receptacle housing support portion, the support portion, and the like.

Further, the first plug shield and the first receptacle shield may be respectively simply referred to as the plug shield and the receptacle shield. When the two connectors are not distinguished by the shape of the connector, they are simply called the shield. When the two connectors are not distinguished by the shape of the connector, the mating connector fitting to the connector may be referred to as the mating connector. The components of the mating connector corresponding to the shell plane of the connector, the outer conductor shell, the side wall connecting portion, and the like of the connector may be referred to as the mating shell plane, the mating outer conductor shell, the mating side wall connecting portion, and the like.

With the structure illustrated in FIGS. 1 to 9, in the connector device and the connector according to the embodiment of the present disclosure, when the connectors are fitted to each other, by the contact portion 127 extending from one shell plane out of the plug shell plane 123 and the receptacle shell plane 223 that face each other to the other shell plane side, the two planes contact each other and are electrically connected to each other. Thus, the plug shell 120 and the receptacle shell 220 are electrically connected to each other. Therefore, the potential difference between the first plug shield 121 that electromagnetically shields the plug terminal 130 of the plug connector 100 and the first receptacle shield 221 that electromagnetically shields the receptacle terminal 230 of the receptacle connector 200 is substantially removed. Therefore, a sufficient electromagnetic shielding effect can be obtained.

When the plug connector 100 and the receptacle connector 200 are fitted to each other, the first receptacle housing support portion 224 is fitted between the first plug housing support portion 124 and the second plug housing support portion 126. Further, the second plug housing support portion 126 is fitted between the first receptacle housing support portion 224 and the second receptacle housing support portion 225. Furthermore, the plug side wall connecting portion 129 and the receptacle side wall connecting portion 227 contact each other. Thus, the plug shell 120 and the receptacle shell 220 are electrically connected to each other. As a result, the potential difference between the first plug shield 121 and the first receptacle shield 221 is substantially removed. Therefore, the same electromagnetic shielding effect can be obtained.

As illustrated in FIG. 8, in the plug connector 100, the mounting end 131 and the first plug shield 121 face each other via the first interval 115 as a space provided between the mounting end 131 and the first plug shield 121. Thus, electromagnetic waves generated near the mounting portion 132 can be shielded. Further, it is possible to favorably prevent the electromagnetic waves from leaking to the outside of the plug connector 100. Similarly, in the receptacle connector 200, the mounting end 231 and the first receptacle shield 221 face each other via the first interval 215 as a space provided between the mounting end 231 and the first receptacle shield 221. Thus, the electromagnetic waves generated near the mounting portion 232 can be shielded. Further, it is possible to favorably prevent the electromagnetic waves from leaking to the outside of the receptacle connector 200. That is, even when a high-frequency coaxial signal or a differential signal is transmitted to the plug terminal 130 and the receptacle terminal 230, the electromagnetic waves do not substantially leak from the connector device, so that a sufficient electromagnetic shielding effect can be obtained.

Further, with such a structure, in the connector device and the connector according to the present embodiment, the plug shield and the receptacle shield are suppressed from overlapping each other in the short direction (Y-axis direction). Therefore, it is possible to avoid the double structure of the inner and outer shields that hinders miniaturization of the connector. Therefore, it is possible to contribute to reduction of the area occupied by the connector on the substrate and to high-density mounting. Individual embodiments, modifications, and the like of the present disclosure are not independent, and can be combined to be appropriately implemented.

Expressions "parallel" and "right angle" in the present specification include not only parallel and right angle in a strict sense but also substantially parallel and right angle.

A technology according to an aspect of the present disclosure can also be said to relate to a connector device for connecting the substrates, that is suitable for high-speed transmission of electric signals and includes the plug connector and the receptacle connector. Specifically, the shield structure of the connectors of the connector device according to the aspect of the present disclosure can shield the high-frequency electromagnetic noise signal generated from the terminals of the connectors, when the plug connector and the receptacle connector are fitted to each other and electrically connected to each other.

The connector according to the aspect of the present disclosure can be used for applications such as connecting the substrates by the flat cable in the electronic devices such as smartphones and mobile phones performing high-speed transmission of the electric signals.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector device comprising:

a plug connector including a plurality of plug terminals, a plug housing that holds the plurality of plug terminals in its longitudinal direction, and a plug shell held by the plug housing; and a receptacle connector including a plurality of receptacle terminals, a receptacle housing that holds the receptacle terminals along its longitudinal direction, and a receptacle shell held by the receptacle housing, wherein the plug shell includes a plug shell plane facing the receptacle connector when the connectors are fitted to each other, a plate-like first plug shield extending in the longitudinal direction of the plug housing, a plate-like second plug shield extending in a short direction of the plug housing, a plug housing support portion held by the plug housing, and a plug shell mounting portion connected to a ground potential of a substrate, the first plug shield faces the plug terminals in the short direction, the receptacle shell includes a receptacle shell plane facing the plug connector when the connectors are fitted to each other, a plate-like first receptacle shield extending in the longitudinal direction of the receptacle housing, a plate-like second receptacle shield extending in a short direction of the receptacle housing, a receptacle housing support portion held by the receptacle housing, and a receptacle shell mounting portion connected to the ground potential of the substrate, the first receptacle shield faces each of the plurality of the receptacle terminals in the short direction, one shell plane out of the plug shell plane and the receptacle shell plane includes a contact portion, which extends from the corresponding shell plane, is formed by being bent in a fitting direction with a mating connector, and is configured to contact the other shell plane when the connectors are fitted to each other, and when the plug connector and the receptacle connector are fitted to each other, the plug shell and the receptacle shell are electrically connected to each other through at least the contact portion.

2. The connector device according to claim 1, wherein the contact portion is a contact piece having elasticity, and is configured to contact the other shell plane to be pushed down, when the connectors are fitted to each other, and one connector out of the plug connector and the receptacle connector, which includes the one shell plane including the contact portion, has a space for accommodating the contact portion pushed down.

3. The connector device according to claim 1, wherein the plug shell plane or the receptacle shell plane includes a protrusion formed to protrude from its surface, and the protrusion is configured to contact the shell plane of the mating connector when the plug connector and the receptacle connector are fitted to each other.

4. The connector device according to claim 1, wherein the plug housing includes a fitting recess surrounded by a first fitting side wall extending in the longitudinal direction and a second fitting side wall extending in the short direction, and a first plug side wall extending in the longitudinal direction and a second plug side wall extending in the short direction, which surround the first fitting side wall and the second fitting side wall, the plug housing support portion includes a first plug housing support portion provided on the second plug side wall and a second plug housing support portion provided on the second fitting side wall, the receptacle housing includes a fitting protrusion surrounded by a first receptacle side wall extending in the longitudinal direction and a second receptacle side wall extending in the short direction, the receptacle housing support portion includes a first receptacle housing support portion provided on the second receptacle side wall and a second receptacle housing support portion provided on the fitting protrusion, and when the plug connector and the receptacle connector are fitted to each other, the first receptacle housing support portion is fitted between the first plug housing support portion and the second plug housing support portion, and the second plug housing support portion is fitted between the first receptacle housing support portion and the second receptacle housing support portion, so that the plug shell and the receptacle shell are electrically connected to each other.

5. The connector device according to claim 4, wherein the plug shell includes a plug side wall connecting portion provided on the first plug side wall near a corner in which the first plug side wall and the second plug side wall intersect, the receptacle shell includes a receptacle side wall connecting portion provided on the first receptacle side wall near a corner in which the first receptacle side wall and the second receptacle side wall intersect, and when the plug connector and the receptacle connector are fitted to each other, the plug side wall connecting portion and the receptacle side wall connecting portion contact each other, so that the plug shell and the receptacle shell are electrically connected to each other.

6. The connector device according to claim 1, wherein the plug housing includes a first plug outer wall that covers the first plug shield and a second plug outer wall that covers the second plug shield, the plug shell mounting portion is exposed from the first plug outer wall or the second plug outer wall, the receptacle housing includes a first receptacle outer wall that covers the first receptacle shield and a second receptacle outer wall that covers the second receptacle shield, and the receptacle shell mounting portion is exposed from the first receptacle outer wall or the second receptacle outer wall.

7. The connector device according to claim 4, wherein the plug terminals are provided along the first fitting side wall, the first plug shield faces the first fitting side wall provided with the plug terminals at equal intervals in the short direction, the receptacle terminals are provided along the first receptacle side wall, and the first receptacle shield faces the first receptacle side wall provided with the plurality of receptacle terminals at equal intervals in the short direction.

8. The connector device according to claim 1, wherein the first plug shield is an edge portion of the plug shell bent at a right angle to the plug shell plane, and the first receptacle shield is an edge portion of the receptacle shell bent at a right angle to the receptacle shell plane.

9. The connector device according to claim 4, wherein the plug shell planes extend in the longitudinal direction on both sides of the fitting recess, the receptacle shell planes extend in the longitudinal direction on both sides of the fitting protrusion, and two of the contact portions are provided on each of the plug shell planes that extend in the longitudinal direction on both sides of the fitting recess or on each of the receptacle shell planes that extend in the longitudinal direction on both sides of the fitting protrusion.

10. The connector device according to claim 1, wherein the plug shell has two cuts in the plug shell plane, and the two cuts are located point-symmetrically with respect to a central axis in the fitting direction, and the receptacle shell has two cuts in the receptacle shell plane, and the two cuts are located point-symmetrically with respect to the central axis in the fitting direction.

11. A connector comprising a plurality of terminals, a housing that holds the terminals in its longitudinal direction, and an outer conductor shell held by the housing, wherein the outer conductor shell includes a shell plane facing a mating connector at the time of fitting, a plate-like first shield extending in the longitudinal direction of the housing, a plate-like second shield extending in a short direction of the housing, a support portion held by the housing, and a shell mounting portion connected to a ground potential of a substrate, the first shield faces each of the terminals in the short direction, the shell plane includes a contact portion, which extends from the shell plane, is formed by being bent in a fitting direction with the mating connector, and is configured to contact a mating shell plane of the mating connector when the connectors are fitted to each other, and the outer conductor shell is electrically connected to a mating outer conductor shell of the mating connector through at least the contact portion in a fitting state with the mating connector.

12. The connector according to claim 11, wherein the contact portion is a contact piece having elasticity, and is configured to contact the mating shell plane of the mating connector to be pushed down, when the connectors are fitted to each other, and the connector has a space for accommodating the contact portion pushed down.

13. The connector according to claim 11, wherein the shell plane includes a protrusion formed to protrude from its surface, and the protrusion is configured to contact the mating shell plane of the mating connector in the fitting state with the mating connector.

14. The connector according to claim 11, wherein the housing includes a fitting portion, a first side wall extending in the longitudinal direction and a second side wall extending in the short direction, which surround the fitting portion, the support portion includes a first support portion provided on the second side wall and a second support portion provided on the fitting portion, and in the fitting state with the mating connector, a mating support portion of the mating connector is fitted between the first support portion and the second support portion, so that the outer conductor shell is electrically connected to the mating outer conductor shell of the mating connector.

15. The connector according to claim 14, wherein the outer conductor shell includes a side wall connecting portion provided on the first side wall near a corner in which the first side wall and the second side wall intersect, and in the fitting state with the mating connector, the side wall connecting portion contacts a mating side wall connecting portion of the mating connector, and the outer conductor shell is electrically connected to the mating outer conductor shell of the mating connector.

16. The connector according to claim 11, wherein the housing includes a first outer wall that covers the first shield and a second outer wall that covers the second shield, and the shell mounting portion is exposed from the first outer wall or the second outer wall.

17. The connector according to claim 14, wherein the plurality of terminals is provided along the first side wall, and the first shield faces the first side wall provided with the plurality of terminals at equal intervals in the short direction.

18. The connector according to claim 11, wherein the first shield is an edge portion of the outer conductor shell bent at a right angle to the shell plane.

19. The connector according to claim 14, wherein the shell plane extends in the longitudinal direction on both sides of the fitting portion, and two of the contact portions are provided on each of the shell planes extending in the longitudinal direction on both sides of the fitting portion.

20. The connector according to claim 11, wherein the outer conductor shell has two cuts in the shell plane, and the two cuts are located point-symmetrically with respect to a central axis in the fitting direction.

21. The connector according to claim 11, wherein the connector is a receptacle connector or a plug connector.

* * * * *